US010384699B2

(12) United States Patent
Gokmen

(10) Patent No.: US 10,384,699 B2
(45) Date of Patent: Aug. 20, 2019

(54) SYSTEM WHICH SENSES RAIL FRACTURES AND CRACKS THROUGH THE METHOD OF REFLECTION

(71) Applicant: Sabri Haluk Gokmen, Ankara (TR)

(72) Inventor: Sabri Haluk Gokmen, Ankara (TR)

( * ) Notice: Subject to any disclaimer, the term of this patent is extended or adjusted under 35 U.S.C. 154(b) by 437 days.

(21) Appl. No.: 15/313,547

(22) PCT Filed: May 21, 2015

(86) PCT No.: PCT/TR2015/000226
§ 371 (c)(1),
(2) Date: Nov. 22, 2016

(87) PCT Pub. No.: WO2015/178868
PCT Pub. Date: Nov. 26, 2015

(65) Prior Publication Data

US 2017/0151966 A1 Jun. 1, 2017

(30) Foreign Application Priority Data

May 22, 2014 (TR) ..... 2014/05723

(51) Int. Cl.
*B61L 23/04* (2006.01)
*B61K 9/10* (2006.01)
*B61L 27/00* (2006.01)

(52) U.S. Cl.
CPC ..... *B61L 23/044* (2013.01); *B61K 9/10* (2013.01); *B61L 27/0088* (2013.01); *B61L 27/0005* (2013.01); *B61L 27/0094* (2013.01)

(58) Field of Classification Search
CPC ..... B61L 23/044; B61L 27/0088; B61K 9/10
(Continued)

(56) References Cited

U.S. PATENT DOCUMENTS 1,771,449 A * 7/1930 Schieferstein ..... B61L 23/044 246/121
4,429,576 A * 2/1984 Norris ..... G01N 29/265 73/609

(Continued)

FOREIGN PATENT DOCUMENTS

DE 100 65 954 A1 3/2002
EP 0514702 A1 * 11/1992 ..... B61L 23/044

(Continued)

OTHER PUBLICATIONS

International Search Report, dated Oct. 5, 2015 for corresponding International Application No. PCT/TR2015/000226.

(Continued)

*Primary Examiner* — Zachary L Kuhfuss
(74) *Attorney, Agent, or Firm* — Intellectual Property Law Group LLP

(57) ABSTRACT

The subject of the invention a method of sensing rail fractures and/or cracks, whereby control is ensured via a control center (700) and which communicates with such command cards (300 and 400), in order to drive and control the rail blocks (200) for applying vibration signal to the rail (100) and also sensing the signal coming from the faulty rail sections directly in the form of reflections and/or change in the amplitude level of signal received by the help of sensors (310), via a fiber optic line (800). The invention is a method of sensing rail fractures or cracks, which allows the receiver and transmitter to have data exchanges between them by fixing them on the rail at certain points rather than by moving them across the line, namely initiates the operation of sensing through transmission of a certain signal via a fixed point and ensuring collection of signals at the same point again, by sensing the reflection of the original signal wave coming back from the deformation points such as fractures, cracks and even micro cracks, etc., and also (Continued)

Figure 1:
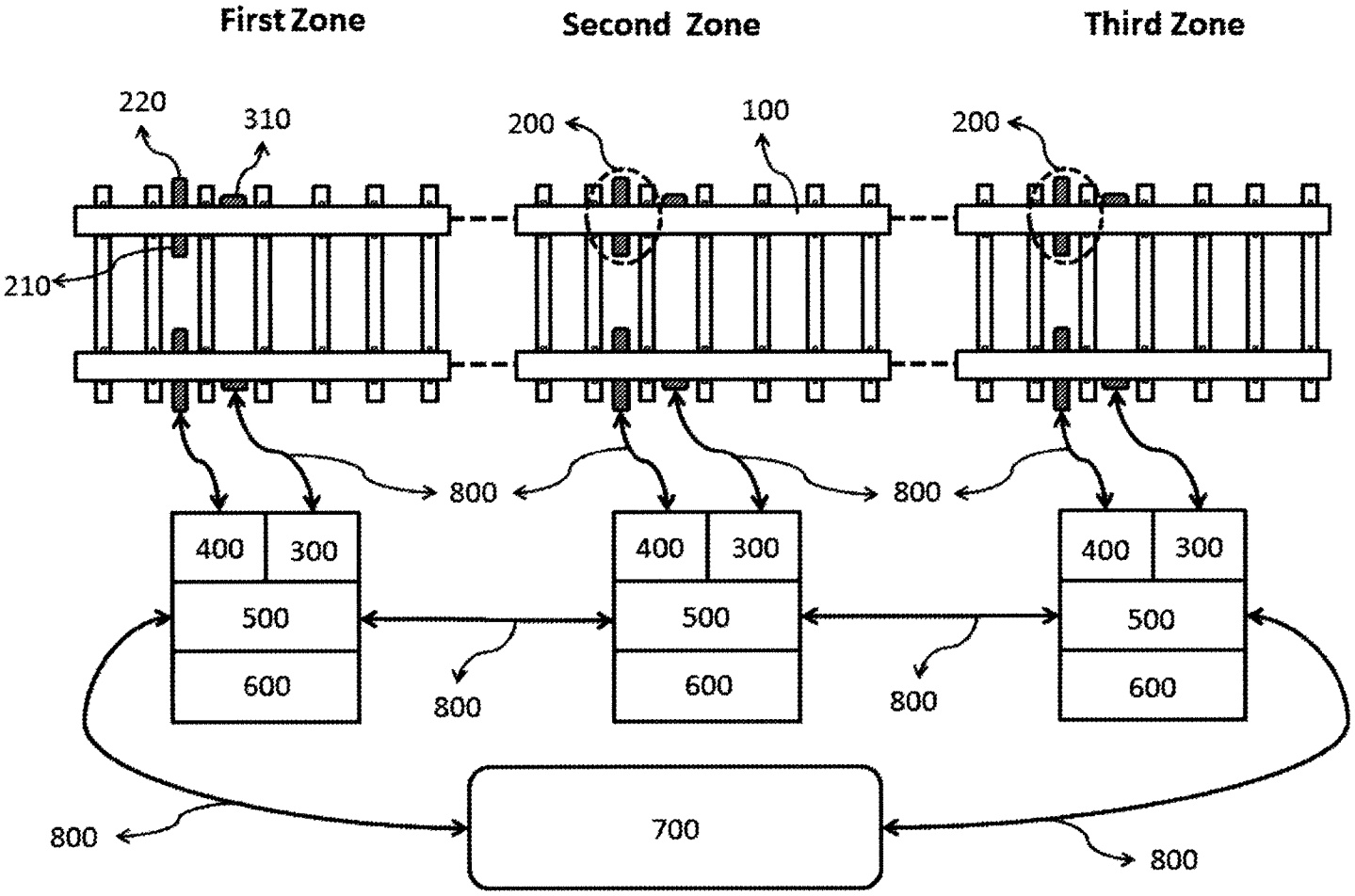

transmission of the signal wave to the receiver (310), located on the other side of the deformation, and comparing the amplitude of the signal received with the reference amplitude level. A mutual correlation of both results by the control center (700) gives a more reliable result.

2 Claims, 3 Drawing Sheets

(58) Field of Classification Search
USPC ..... 246/120
See application file for complete search history.

(56) References Cited

U.S. PATENT DOCUMENTS 4,932,618 A * 6/1990 Davenport ..... B61L 1/02 180/169
5,522,265 A * 6/1996 Jaeggi ..... B61K 9/10 73/431
5,713,540 A * 2/1998 Gerszberg ..... B61L 1/06 246/121
5,743,495 A * 4/1998 Welles, II ..... B61L 23/044 246/121
6,055,862 A * 5/2000 Martens ..... G01N 29/2493 73/632
6,895,362 B2 * 5/2005 Davenport ..... B61L 23/041 246/120
6,951,132 B2 * 10/2005 Davenport ..... B61L 1/06 246/169 S
7,226,021 B1 * 6/2007 Anderson ..... B61L 1/181 246/120
2008/0142645 A1 6/2008 Tomlinson
2012/0217351 A1 * 8/2012 Chadwick ..... B61L 25/021 246/169 R
2017/0151966 A1 * 6/2017 Gokmen ..... B61K 9/10

FOREIGN PATENT DOCUMENTS

GB 2372569 A * 8/2002 ..... B61K 9/10
WO WO 2004/068132 A1 8/2004
WO WO 2014/027977 A1 2/2014

OTHER PUBLICATIONS

Written Opinion of the ISA, dated Oct. 5, 2015 for corresponding International Application No. PCT/TR2015/000226.

* cited by examiner

SYSTEM WHICH SENSES RAIL FRACTURES AND CRACKS THROUGH THE METHOD OF REFLECTION

CROSS-REFERENCE TO RELATED APPLICATIONS

This application is a U.S. National Phase application, under 35 U.S.C. § 371, of International Application no. PCT/TR2015/000226, with an international filing date of May 21, 2015, and claims benefit of Turkish Application no. 2014/05723 filed on May 22, 2014, and which are hereby incorporated by reference for all purposes.

TECHNICAL FIELD

The invention is related to the method of sensing rail fractures or cracks, which may be used in detection of railway rail failures in the field of rail systems technology.

The invention is in particular the method of sensing rail fractures or cracks, which allows the receiver and transmitter to have data exchanges between them by fixing them on the rail at certain points rather than by moving them across the line, namely initiates the operation of sensing through transmission of a certain signal via a fixed point and ensures sensing and assessment of the original signal coming from both the same point and other points after undergoing certain transformation and/or of the signal coming back after reflecting from the failure points and further ensures that the signal sent comes back, with the original signal wave undergoing transformation upon encountering with rail deformations such as cracks, fractures and micro fractures, etc., and/or upon reflecting from the relevant deformation and that subsequently, this reflecting signal wave is transmitted to the receiver and that deformation is finally sensed and assessed upon conversion of such signals into electrical signals.

Former Technique

All over the world, railway transport systems steadily become more important because they are fast, cost effective, environmentally friendly, safe and contemporary systems. One of the most important features of the railway systems is that they are highly reliable means of mass transport. Sustainability of this feature may undoubtedly be secured through regular maintenance conducted on these systems. As far as such maintenance is concerned, deformation measurements and detection of any fractures and cracks on rail occupy a significant place. Deformations taking place on the rail systems mainly arise from such expansions and shrinkages resulting from the railway rolling stock wheel sets being worn and losing their normal shapes, presence of higher forces transferred to external rail due to the centrifugal force on the curbs/bends, trains traveling at speeds higher than those allowed, both rails failing to be at a uniform height level and climatic variations as well as many other similar reasons. Decomposition, crusting and similar phenomena of oxidization which take place on the surfaces of rails, which are highly affected by water, moisture and soil due to their chemical composition, lead to substantial deformations on rails. Given this, it is more important to detect any deformations on rails including any such factors threatening safety.

In the present technique, the railway line is divided into zones having certain lengths and track circuits, which sense existence of trains, are used inside these zones. A rail zone having a length of approximately 1 km is kept by a track circuit under control electrically. A train entering into this zone is sensed by the track circuit connected to the rail, with such information being transmitted to the signaling system to which the line is connected. Such track circuits may also be used as the rail fracture sensing circuit at the same time. But, because the rails are also used as the return line of the catenary system at the same time, such rail fracture information obtained by the track circuits may often become misleading and as a result, such information is not relied on.

In the present technique, use is often made of the railway track control officers in detection of rail cracks and fractures. These officers control rails having lengths of many kilometers with the aid of visual methods or basic manual measurement tools step by step. The fact that railway lines have an overall length of millions of kilometers all over the world and that this operation is carried out by manpower demonstrates that the method is highly unpractical. Again, considering the potential existence of fractures, cracks or deformations on the rails, very colossal railway accidents might take place, with a high number of casualties, due to difficult detection or non-detection of such conditions.

Yet another method in the present technique involves such systems incorporating electronic cameras, sensors and a computer connected to them, which achieve detection of rail cracks and deformations. In these systems, fractures and deformations on the rails may be detected with the aid of particular cameras and sensors which may be installed on the bottom sections of any wagons or rail buses in such a manner and to such an extent ensuring that they are able to see the rails, as well as a computer system connected to them and software packages thereof. Apart from the fact that this method involves expensive technologies, the requirement on the part of the electronic devices on the system to be in constant contact with external setting causes destruction or damage on the devices and prevents the system from taking measurements properly and precisely. In addition, information on rail fractures, cracks or deformations cannot be obtained instantaneously; most current data may be acquired only after a given line is used by a train.

Yet another method in the present technique is detection of rail fractures and deformations by means of the method of photography. Again, electronic sensors and GPS (Global Positioning System) navigational systems are mounted on the bottom sections of wagons and any other rolling stock and sensors detect any deformations as soon as a railway vehicle crosses across a fractured or deformed section. It simultaneously warns GPS navigation system accordingly at the same time, with such a navigation system communicating the position of this deformed area to the computer. In such types of methods, such minor or micro cracks and fractures which are not visible to the bare eyes but might later prove problematic and later on cannot be observed in a precise manner. As is the case for the preceding technique, data are only available after a train uses the respective line under this technique. This situation threatens human safety.

Many other methods are available in the present technique. To name a few, some of them are laser, precision sensors and high resolution cameras capable of taking fast recordings. The common problem with such types of systems is that they must be applied to a train having minimum two wagons or alternatively, a railway vehicle having particular dual wagons and engines is required and that data on fractures, cracks or deformations is available only after such vehicles travel on the respective line. Because cracks, fractures or deformations might develop during train crossings or due to climatic reasons at any time, formation of such a set of trains and causing it to travel on train for measurement purposes would not sometimes contribute to sensing of problems in any manner and accidents could still occur.

As a result of the preliminary investigation conducted on the present technique, Patent Files No's U.S. Pat. No. 7,716,010 and US20120216618 have been reviewed. Ultrasonic testing devices or static test devices have been used in this method. For example, sound is fed to a point of rail from an ultrasonic sound source and whether there is any cavity at that point may be tracked from the character of the sound received. Point analyses may only be made by ultrasonic devices. These devices are placed on a maintenance train and this train is then set on a tour of measurements on the line at a lower speed at times such as midnight when the line would be less intensive or generally unoccupied. The measurement train would take measurements on the line until morning, extracting necessary data and communicating them to the maintenance/repair teams. This is a very heavy and expensive method.

Patent Files No's CN201971030 (U) and CN201721463 (U) have been reviewed as a result of the preliminary investigation conducted on the present technique. Integration of the line is measured by this method. Although this method is a currently used method, because in particular, the line is used as the return current line of the catenaries system, it often provides erroneous or misleading data and is not adequate and practical as it is highly costly.

Patent No US20100026551 is another patent encountered as a result of the preliminary investigation conducted on the present technique. In this patent, electromagnetic testing devices (GPR=Ground Penetrating Radar) are used. For example, electromagnetic wave is fed to a point of rail from an electromagnetic wave source and whether there is any cavity at that point may be tracked from the character of the sound received from other section. These devices are placed on a maintenance train or on a specially prepared vehicle which is capable of moving on the rail and such vehicles then set on a tour of measurements at a lower speed at such times when the line would be less intensive or generally unoccupied. Specific points where there would be fractures or cracks on the measured line might be detected after the measurements received would undergo a certain stage of data processing. And this situation imposes burdens in terms of both time and costs.

U.S. Pat. No. 5,743,495 is another patent encountered as a result of the preliminary investigation conducted on the present technique. This patent refers to reception of vibrations arising from the moving railway vehicle by means of sensors and assessment of the signals obtained. These types of systems are passive systems and a railway vehicle would be expected to cross across the deformed rail for measurement. It might be too late when a railway vehicle would cross across the deformed rail and accordingly, vehicle derailment and similar circumstances might be experienced. Therefore, such types of systems have also failed to provide a solution to current problems.

Patent No DE19858937 is another patent encountered as a result of the preliminary investigation conducted on the present technique. When the relevant patent is reviewed, it is observed that there is a reference therein to the scheme of the method of collection by sensors of sounds generated by the railway vehicle by means of such sensors positioned on the railway and issuing an alert to the railway vehicles on the deformations on the rail by means of several different methods. The systems and methods referred to therein would always require a railway vehicle. Namely, it would not be possible to sense any deformations on the rail and issue an alert thereof unless a railway vehicle would have crossed in advance.

Patents No's US2004/172216 and EP0514702 are other patents encountered as a result of the preliminary investigation conducted on the present technique. Based on an analysis of the relevant patent, transmitting sources are placed at different points by means of such sensors which are positioned on the railway. On the systems which are referred o by these files, detection of fracture is carried out upon identification of decline in signal output if there would be an apparent fracture between the sensor and source. And these systems also fail to detect any such mini/micro deformations because they are not capable of identifying the reflection properties.

In conclusion, the requirement for a multi-functional system and method of sensing rail fractures or cracks, which have much more reliable and various advantages as against the comparable to eliminate the disadvantages already outlined above as well as inadequacy of currently available solutions have required performance of a development in the relevant technical field.

OBJECTIVE OF THE INVENTION

The subject invention is, in its most general form, the method of sensing rail fractures and/or cracks, whereby control is ensured via a control center and which incorporates a central command control program and command cards through which commands are sent to the system cards located in the field via a fiber optic line that are capable of converting such commands into action for sensing the fractures and cracks of the rail segment connected.

Briefly, this method includes the following steps of operation;

- sending commands to the solenoid driving card and sensor card which are positioned alongside the track, by means of the fiber optic line from the control center,
- supply of power by the solenoid driving card to the solenoid engine upon the command received,
- switching on the receivers of the sensors by means of this command received again,
- measurement of initial impact created by the solenoid on the rail, upon the switching on of the receivers of the sensors,
- solenoid hammer hitting the rail block at such pre-designated impact severity,
- ensuring that severity of the impacts applied by the solenoid hammer to the rail are done in a controlled manner, by means of the sensor,
- in cases where impact would have taken place at a pre-designated range of impact, transmitting such data to the control center and some other sensors,
- in cases where impact would be within the pre-designated range of severity values, relevant sensors waiting for the reflection signal,
- in cases where impact would be within the pre-designated range of severity values, waiting by such sensors tracking the decline in the signal amplitude,
- in cases where there would be any such fractures or cracks on the line, their comeback as a reflection to the nearest sensor at the point where the signal is generated,
- assessment by the relevant sensors of any variations to the signal amplitude as well as of the findings in connection with reflection and transmission of assessment results by the fiber optic line to the relevant control center, sensor switching off its receivers in cases where no relevant signal would arrive at the pre-designated range of time and assessment of the testing results received from the relevant sensors by the computer program at the center and reaching a conclusion on the zone tested.

The following major objectives are the elements which distinguish the invention from the systems in the present technique, which transmit signals and receive signals from a different point;

it allows for data exchanges between fixed points, rather than by moving the receiver and transmitter on a railway line; namely, it is a system which achieves the operation by sending signals from the same fixed point and ensures collection of signals at the same point again, it uses the feature of reflection; namely, as regards a signal sent, the signal wave reflects from the relevant deformation in cases where any deformations such as fractures, cracks and even micro cracks, etc., would be come across and such reflecting signal wave is transmitted back to the receiver, at the same time the loss of amplitude suffered by the signal sent, as it would pass through a deformed section such as fractures and cracks is measured and, a conclusion is reached upon an integral assessment of results incoming from both the sensor sensing reflection and sensor tracking variations to amplitude in order to be able to reach a decisive and more precise result in connection with rail deformation.

Yet another objective of the invention is to prevent the solenoid hammer from inflicting any deformation on the rail body through direct contact with a point on the rail by using a rail block during measurement.

The objective of the invention is its capability of detecting any deformations such as cracks, fractures, etc., on the railway line, whether or not visible by bare eyes, immediately after such problems have developed. Location of any errors could also be easily spotted because, as per the method, the line is divided into certain zones and the return time of the reflecting signal may be measured precisely at the same time.

In addition, no railway vehicles would be required during achievement of this operation and thus, it would be ensured that any deformations such as cracks, fractures, etc., developing on the rails of the railway line would be detected in advance and that consequently, any major accidents that would otherwise take place, would be prevented effectively.

Yet another objective of the invention is its capability of eliminating such inadequacies of point analyses conducted by ultrasonic and electromagnetic testing devices and easily, permanently and rapidly detecting any deformations such as fractures, cracks, etc., along a line. In general, fractures take place at the time of trains crossing, becoming apparent later on, or at such times when the line would be coldest and hottest. Therefore, it is an essential difference to collect and assess fracture data regularly. In conclusion, any physical problems on the rail must be immediately sensed so that any potential accidents could be avoided effectively.

Yet another objective of the invention is its capability of detecting not only such sections visible merely on the rail top surface by means of such electronic and camera sensors used by the present technique but also any such fractures or deformations developing in any sections of the rail body.

Yet another objective of the invention is its capability of providing convenience in terms of both costs and operating methods as compared to lasers, sensors, high resolution cameras able to take rapid shootings and any other similar systems as well as eliminating the disadvantages of these systems by means of its simple structure.

Yet another objective of the invention is its capability of, thanks to this system used, detecting any such rail defects throughout a line at the early stage of development or as they have just developed and issuing necessary alerts before a train would reach such a problematic zone.

The invention, which makes up for the adverse aspects of currently used configurations in line with the objectives mentioned herein, is the system of sensing rail fractures or cracks, which may be used in detection of railway rail failures in the field of rail system technologies and incorporates: an electromechanical rail block, which is positioned on the rail and transmit to the rail the mechanical energy to be applied to the rail without applying any direct point-impact on to the rail; the first rail block which is instrumental in cladding the subject rail block on the subject rail and fixing it there; a minimum second rail block, which accommodates the subject solenoid engine on it and applies impact on its own body with the solenoid hammer again on it and is formed in such a manner compatible with the subject first rail block and minimum one coupling element, which interconnects the subject first rail block and subject second rail block and thus ensures the positioning of the subject rail block on the rail foot section.

Again, the invention is the method of sensing rail fractures or cracks, which may be used to detect railway rail failures in the field of rail system technologies and involves the steps of operations for;

designation of a range of impact severities which would be transmitted to the rail system from the control center, transmission of (300) commands to the solenoid driving cards and sensor cards in the application units installed all along the rail by means of the fiber optic line coming out from the control center, application of impacts by solenoid hammers to the rail blocks at such impact severity as designated in the control center, comparison by the nearest sensor of impact severity with the impact severity as designated in the control center after impact is applied, in case of an impact not having been applied at the pre-designated severity range, transformation of such information to the control center and repetition of such impact at proper severity range, in case of an impact having been applied at the pre-designated severity range, progress of the signal sent as far as the deformed rail deformation, signal sent being reflected from the deformed point and such signal coming back to the first sensor, located next to the signal generation point on the rail, performance of initial inspection by this sensor, on the reflected signal data coming to the sensor and transmission of the result of this inspection process to the control center concerning deformation, which are recorded for a certain period of time, signal generated reaching to the second sensor on the far side to the signal generation point at such a value below the pre-designated limit values in the signal amplitude by passing through the deformed point, performance by the sensor of initial inspection on the data carried on the signal with decreased amplitude, which comes to the second sensor via the deformed zone; comparison with such limit values which are earlier recorded on the data base and transmission to the control center of original signal registration data and/or amplitude based sensing result data concerning deformation, which are recorded for a certain period of time, these two sensors detecting reflection signals in two directions and transmitting necessary data to the control center, mutual comparison by the control center of such reflection data incoming from different sensors as well as of such signal data incoming after directly passing through the deformed zone, performance of detection of specific distances regarding the exact points where there has been deformation, because the critical information is available on the diffusion speeds and arrival times of such reflection signals and directly sensed amplitude related signals transmitted by multiple sensors to the control center, as a result of transmission to the control center of data on decrease in the signal amplitude sensed by the sensors on both side zones throughout the relevant testing processes as well as the reflection signal sensed by the sensor which senses the reflection signal, formation of more decisive defect sensing in connection with the deformation on the rail, detection by the above mentioned multiple sensors of change in reflection information and amplitude information in two directions and transmission of data to the control center in connection therewith, mutual comparison by the control center of data on signals of reflection and amplitude from different sensors, identification of position of the deformed point via reflection data incoming from multiple sensors as there is information on the diffusion speeds and times and, detection of more reliable rail defect sensing by supporting the defect data obtained from the reflection signal with such data determining decrease in the signal amplitude as sensed by the zonal sensors on both sides.

The structural and characteristic features and any advantages of the invention will be more clearly understood thanks to the figures provided below and detailed explanation drafted by reference to these figures. Therefore, assessment must be made by taking into consideration these figures and detailed explanation.

FIGURES WHICH WILL BE INSTRUMENTAL IN PROVIDING A BETTER UNDERSTANDING OF THE INVENTION

FIG. 1: It is the drawing which schematically indicates the operating principle of the method of sensing rail fractures or cracks, which is covered by the invention hereunder.

Figure 2:
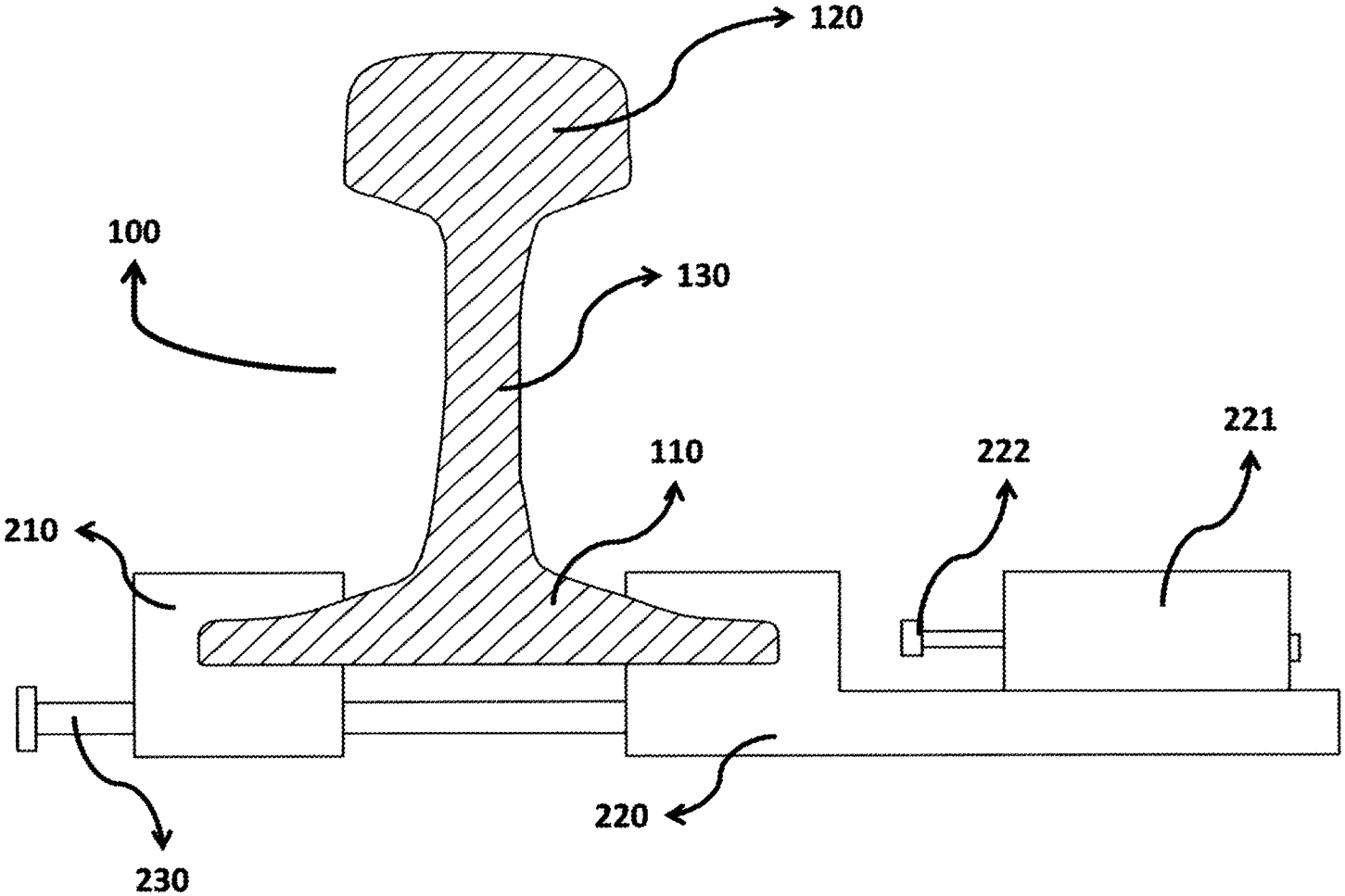

FIG. 2; It is the drawing which indicates in cross section the application of the rail block to rail in the method of sensing rail fractures or cracks, which is covered by the invention hereunder.

Figure 3:
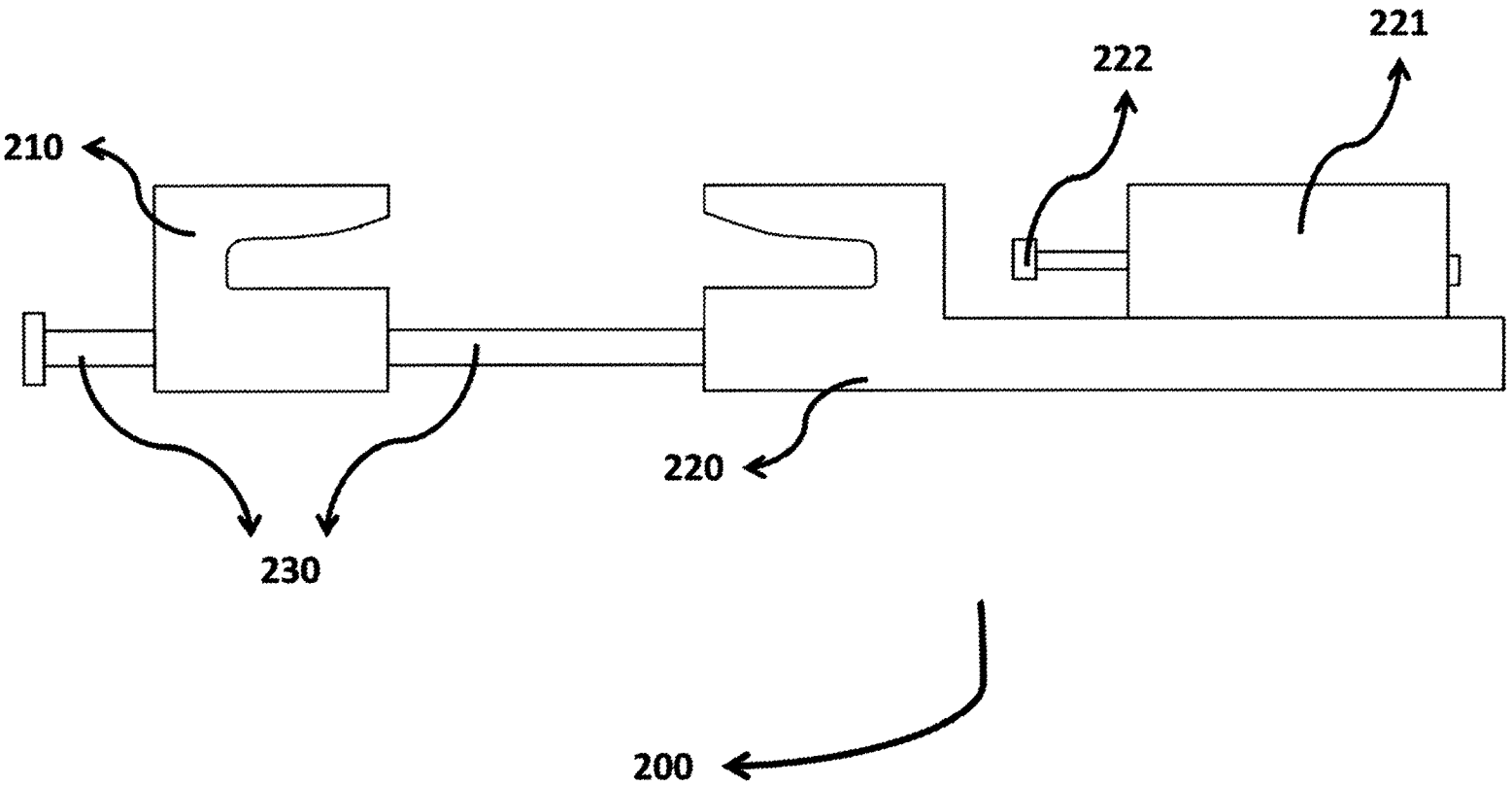

FIG. 3: It is the drawing which indicates the rail block in the method of sensing rail fractures or cracks, which is covered by the invention hereunder.

REFERENCE NUMBERS

100. Rail
110. Rail foot
120. Rail head
130. Rail web
200. Rail block
210. First Rail Block
220. Second Rail Block
221. Solenoid Engine
222. Solenoid Hammer
230. Coupling Element
300. Sensor Card
310. Sensor
400. Solenoid Driving Card
500. Fiber Optic Communication Card
600. Power Supply
700. Control center
800. Fiber optic line

DETAILED EXPLANATION OF THE INVENTION

FIG. 1 indicates the operating principle diagram of the method of sensing rail fractures or cracks, which is covered by the invention hereunder. For illustrative purposes, a sample measurement rail line with a total length of 4 km (100) will be assumed as reference, which comprises three measurement groups at an interval of 2 km, as details of the study are outlined. This measurement distance varies as per physical characteristics of the line on which the rail is located. In this example, the measurement groups of the sensing system which are positioned at an interval of 2 km continue up to the end of the rail (100). Explanations will be provided on the basis of the three groups.

Because the natural vibration frequency of the rail (100) is already known, thanks to the signal application to the rail with the aid of the Solenoid Hammer (222), a resonance effect is generated on the rail (100) for a brief period of time. The signal, which is generated by the Solenoid Hammer (222) in the second zone, is sensed by the sensor in the same zone as well as by the first zone sensor (310), 2 km behind it and the third zone sensor (310), 2 km in front of this sensor (310). Thanks to the sensor (310) in the zone where the impact point is located, the system conducts self-control, comparing the impact data to the reference impact data and communicating the results thereof to the control center (700). The same impact signal is sensed by the sensors (310) in the first and third zones as total interruption of signal in case of a full break off and as a drop in the signal severity in reference to the pre-designated limits in case of a fracture. It is ensured that in cases of break off, fracture and crack, the signal concurrently arrives at the sensor (310) immediately next to the impact deliverer by reflecting from the defective point and sensed through a time difference from the original signal.

In the invention, the command which is sent from the control center (700) is transmitted to the Fiber Optic Communication Card (500) of, for example, the application unit in the $2^{nd}$ zone, where testing would be carried out, via the fiber optic line (800) and then to both the Solenoid Driving Card (400) and sensor card (300) By activating the electronic drive circuit on the Solenoid Driving Card (400) through this command coming to the Solenoid Driving Card (400), the energy accumulated on the Power Supply (600) is transmitted to the Solenoid Engine (221) and then, the Solenoid Hammer (222) is thus activated. Upon the activation of the Solenoid Hammer (222), the sensor card (300) transmits a command to the sensor (310), thus activating the receivers of the sensor (310). Immediately after the receivers of the sensor (310) have been activated, the impact severity of the Solenoid Hammer (221) is measured and subsequently, the amplitude level of the vibration signal that is applied to the rail (100) is measured. Thus, whether the signal amplitude level which has been obtained by measuring it by means of the sensor (310) located on the rail (100)

would remain at a pre-designated range is controlled. In the event that the level would be within this range, this sensor (310) in the $2^{nd}$ zone would then start waiting in order to sense the signal that would reflect and return from such a deformation point to which the generated signal would progress up to the potential deformation on the rail (100). At this stage, the vibration which was generated on the rail (100) would extend along the rail (100) and progress on the rail (100) line at a certain speed.

In the event that there would be fractures and cracks on the rail (100) line, this sensor (310) would detect any such signals returning as a reflection. Because the extension speed of the signal on the respective medium is determined thanks to the pre-testing, specific point where there is deformation is also identified in cases where there would be any incoming reflection. This point may be identified by using the formulation, Speed vs. Time because extension speed and signal's two way travel time are already known for this operation. At the same time, the $2^{nd}$ zone sensor card (300) transmits to the fiber optic line (800) via the Fiber Optic Communication Card (500) such information that the signal generated is a valid signal and that applicable testing is initiated. This information is transmitted to both the control center (700) and first and third zones Fiber Optic Communication Cards (500). The Fiber Optic Communication Cards in both zones transmit to their respective sensor cards (300) such information incoming from the sensor card in the $2^{nd}$ zone to the effect that testing has started. Thus, the sensor cards (300) also put the sensors (310) to which they are connected into the mode of active sensing. At this stage, the vibration signal applied by the Solenoid Hammer (222) to the rail (100) in the $2^{nd}$ zone is also monitored by the sensors in the first and third zones. The variation to the amplitude of the vibration signal incoming from the $2^{nd}$ zone is compared to the signals which have been sensed by the sensors (310) in the first and third zones. In the event that the signal amplitude would be below the pre-designated limits, they would then sense potential development of fracture or crack having a certain size on the rail (100) section between the $2^{nd}$ zone and their own zones, communicating such sensing to the control center (700) via the Fiber Optic Communication Card (500) and fiber optic line (800).

A signal extends in a wave form rather than linearly as required by its physical properties. Therefore, whether the signal incoming to the sensor (310) group in the second zone actually originates from the first zone or third zone as per FIG. 1 is not known. In determining this, for example, measurement groups have been developed in three zones at an interval of 2 km for measurement purposes. In the control center (700), the reflection signal data received from the sensor (310) in the second zone are compared to the reflection signal date sensed as a result of tests conducted likewise in the first and third zones. For example, in the event that a fracture or crack detected as per the reflecting signal data acquired by the second zone sensor (310) would also be verified by the third zone sensor (310) at the same time, it would then be determined that the location of the deformation would be somewhere between the second and third zones. Likewise, in the event that a fracture or crack detected as per the reflecting signal data acquired by the second zone sensor (310) would also be verified by the third zone sensor (310) at the same time, it would then be determined that the location of the deformation would be somewhere between the first and second zones. Because the signal starting time is already known, the place of the defective point is precisely located by making use of the data on elapsing time signal speed. Because the number of zones at which measurement groups would be formed along the line sequentially would increase, then, the results of measurements would be highly clear across a long line. The area which is defined as the third zone in the section, explanation, turns into the position of the second group along with the next measurement group and the system is thus looped/translated. As the measurement results are analyzed, the results for the first zone, second zone and third zone are compared on a loop/translation as the system moves on thereby and accuracy of data is checked comparatively.

The reflection signal would complete the two way movement at the range of milliseconds after impact would be applied to the rail in cases where there is a deformation. For this reason, the sensor card (300) would switch off the receivers of the sensor (310) in cases where no reflection signal would arrive at this range of maximum time.

In the application unit, there are: sensor cards (300) which ensures switch on and off of the receivers of the sensor (310) through the command incoming from the control center (700) and ensures digital processing of processed or incompletely processed data coming from the sensor (310); Solenoid Driving Cards (400) which allow the Solenoid Hammer (221) to apply impact at a pre-designated range of severity through the signal supplied from the control center (700); Fiber Optic Communication Cards (500) which ensures through use of a fiber optic line (800) that all these commands are transmitted to other application units and control center in a rapid manner; and Power Supply, which supplies power to each application unit.

Again, FIG. 1 illustrates the method of positioning the rail block (200) and sensor (310) on the rail (100). The rail block (200) consists of two parts and is clad on the rail (100) so that it would not inflict any damages on the rail (100) at the time of delivering impact. One of these parts is the second rail block (220) which accommodates the Solenoid Hammer (221) as the other part is the first rail block (210) which is instrumental in cladding the rail block (200) in the rail (100) and fixing it there.

FIG. 2 and FIG. 3 illustrate the rail block (200) in the method of sensing rail (100) fractures or cracks and its position on the rail (100). In this drawing, the cross section of the rail (100) in which the rail block (200) is clad is illustrated. The rail block (200) prevents the Solenoid Hammer (222) from having direct contact with any point on the rail (100) during measurement process. Thus, any deformations which might develop on the rail (100) are prevented. In addition, in this figure, it is ensured that the system is used without imposing any physical intervention with the rail body (130) by making use of an easily installable and detachable rail block (200). In particular, sections such as the rail web (130) and rail head (120) which might result in highly dangerous consequences in cases where they would be damaged as a consequence of the installation process are prevented from suffering damages. The rail block (200) is clad in the rail foot (110) section of the rail (100), which is sturdier. The First Rail Block (210) and Second Rail Block (220) are interconnected by means of a Coupling Element (230). Thus, a rigid rail block (200) is formed so that the strength of the signal to be transmitted would not deteriorate. The Second Rail Block (220) accommodates the Solenoid Engine (221) and Solenoid Hammer (222), which transmits the force provided by this Solenoid Engine (221) to the rail block (220). Thus, it is ensured that the signal is transmitted to the rail (100) with impacts not being directly applied to the rail (100).

The invention claimed is:

1. A method for sensing rail (100) fractures or cracks used in detection of railway rail (100) failures in the field of rail systems technology and characterized by accommodating at least one rail block (200) positioned on a rail (100), which transmits a mechanical force, including necessary mechanical power, to be applied to the rail (100) without applying direct impact on the rail (100), the method comprising the following steps of operation:

designation of a range of impact severity to be transmitted to system components from a control center (700), transmission of commands to a plurality of Solenoid Driving Cards (400) and sensor cards (300) in application units along sides of the rail (100) via a fiber optic line (800), emerging from the control center (700), application by a plurality of Solenoid Hammers (222) of impact on the at least one rail block (200) at an impact severity as pre-designated by the control center (700), upon application of impact, comparison by a nearest sensor (310) of measured impact severity with the impact severity as pre-designated by the control center (700) in advance, in cases where the impact could not be applied within the range of the pre-designated impact range, transmission of such data to the control center (700) and repetition of impact at an appropriate severity range again, in cases where the impact is applied within the range of the pre-designated impact range, transmission of a generated signal to a deformed point of deformed rail (100), return of the generated signal transmitted, to the sensor (310) located next to an application unit with which the signal is applied to the rail (100) by being reflected from the deformed point, performance by the sensor (310) of initial inspection of reflected signal data incoming to the sensor (310) and transmission to the control center (700) of original recorded signal data and/or deformation related processed reflection result data recorded for a certain period of time, the generated signal passing through the deformed point and reaching another sensor (310) on another side by decreasing by a value in a signal amplitude below the pre-designated limit values, performance by the sensor (310) of initial inspection on the data carried on the signal with lower amplitude, which comes to said another sensor via the deformed zone and transmission to the control center (700) of original recorded signal data and/or deformation related, amplitude based sensing and comparative result data recorded for a certain period of time, detection of reflection signals coming from two directions by the sensors (310) and transmission of necessary processed data to the control center, mutual comparison by the control center (700) of reflection data and directly incoming signal data with amplitude contents, sent from multiple sensors (310), because transmission speeds and arrival times of reflection and directly sensed signals with amplitude contents, sent from the multiple sensors (310) to the control center are already known, determination of a specific point where there is deformation, development of a more decisive defect sensing in connection with the deformation on the rail (100) as a result of dispatch to the control center (700) of data regarding the drop in signal amplitude sensed by the sensors in both side zones throughout the relevant testing processes together with the reflection signals sensed by the sensor (310).

2. The method for sensing rail (100) fractures or cracks, according to claim 1, further comprising the steps of:

detection by the subject multiple sensors (310) of reflection signals in two directions and transmission of such data to the control center (700), mutual comparison by the control center (700) of reflection signal data incoming from different sensors (310), determination of the position of the deformed point by means of reflection data incoming from the multiple sensors (310) because extension speeds and time are already known, performing more reliably for defect sensing upon mutual control of the system deformation data acquired from reflection signal which is sensed by the sensors (310) in both side zones and the signal amplitude changes sensed by the sensors (310) in both side zones.

* * * * *